United States Patent [19]

Sakurai

[11] Patent Number: 4,648,786

[45] Date of Patent: Mar. 10, 1987

[54] PRESS MACHINE

[75] Inventor: Terushige Sakurai, Komatsu, Japan

[73] Assignee: Kabushiki Kaisha Komatsu Seisakusho, Tokyo, Japan

[21] Appl. No.: 448,173

[22] Filed: Dec. 9, 1982

[30] Foreign Application Priority Data

Dec. 15, 1981 [JP] Japan ..... 56-185727[U]
Dec. 15, 1981 [JP] Japan ..... 56-185728[U]
Dec. 15, 1981 [JP] Japan ..... 56-185729[U]

[51] Int. Cl.[4] ..... B25J 15/06

[52] U.S. Cl. ..... 414/752; 414/736; 414/222; 901/16; 901/40

[58] Field of Search ..... 901/16, 40, 41, 30; 414/752, 736, 121, 222; 198/486, 462

[56] References Cited

U.S. PATENT DOCUMENTS 3,451,224 6/1969 Colechia et al. ..... 901/41 X
3,774,778 11/1977 Flaig ..... 414/736
3,951,273 4/1976 de Caussin ..... 901/41 X
3,973,795 8/1976 Goransson ..... 294/65
4,005,782 2/1977 Crockett ..... 901/16 X
4,227,853 10/1980 Woodford et al. ..... 901/30 X
4,411,574 10/1983 Riley ..... 414/121
4,488,241 12/1984 Hutchins et al. ..... 901/30 X

OTHER PUBLICATIONS

Pamphlet, 1977-10/K.2-VI/40E, issued by Fuji Electric Co., Ltd., Japan.

*Primary Examiner*—Terrance L. Siemens
*Attorney, Agent, or Firm*—Armstrong, Nikaido, Marmelstein & Kubovcik

[57] ABSTRACT

A press machine has a transfer device for transferring blanks to be machined from a blank supply station to a blank machining station. The transfer device includes a rail extending in the longitudinal direction of a bed of the press machine and mounted in front of a press machine body through brackets fixedly secured, respectively, to side faces of the press machine body, a main body located in front of the press machine body so as to be movable along the rail, a lift member mounted on the main body so as to be movable in the vertical direction, a transfer unit fitted to the lift member so as to be movable back and forth with respect to the press machine body, and drive units for driving the main body, lift member and transfer unit, respectively.

2 Claims, 10 Drawing Figures

PRESS MACHINE

BACKGROUND OF THE INVENTION

1. Field of the Invention

This invention relates to a press machine, and more particularly to a transfer device adapted to supply blanks to press-machining positions on a table of the press machine and deliver pressed articles therefrom.

2. Description of the Prior Art

Transfer devices for use in press machines which have so far been employed include a system in which a pair of drive units for transfer are mounted on both sides of the press machine body and one or two transfer bars are mounted between the pair of drive units, and another system in which drive units are mounted in front of the press machine body, the arrangement being made such that said drive units can oscillate at least one transfer arm. The above-mentioned system or arrangement, however, is disadvantageous in that the drive units and the transfer bars or the transfer arms stand in the way and make it difficult for the operator to make access to the dies mounted on a bolster, maintenance and inspection of the dies is troublesome to carry out and require a long time.

Further, there have been known a transfer device wherein a pair of feed bars provided with a plurality of clamp claws are arranged to make rectangular motion and those in which feed bars comprising a plurality of clamp members are adapted to move vertically and reciprocate longitudinally. However, in both the transfer devices, the length of feed is constant on the loading side and on the unloading side, respectively. Therefore, when the distance between the position of the blank on the loading side and the press machining position is longer than the distance between each of the press machining positions, it becomes necessary to provide an idle station on the loading side, thus increasing the time for the replacement of dies and also the cost thereof.

Further, in the conventional transfer devices for use in press machines, transfer members such as vacuum-cups or jaws or the like are fitted to a feed bar or feed bars adapted to make two-dimensional or three-dimensional motion by means of bolt or clamp means. In case of replacing the transfer member with a different one, it is required for the operator to replace manually the bolt or clamp means with new ones. Therefore, the replacement operation of the transfer member becomes very troublesome and requires a considerable time.

SUMMARY OF THE INVENTION

The present invention has been contemplated in view of the above-mentioned circumstances, and has for its object to provide a transfer device for use in a press machine constructed such that the maintenance and inspection of dies can be readily carried out for a short time.

Another object of the present invention is to provide a transfer device for use in a press machine wherein the length of feed on the loading side can be varied from that on the unloading side.

A further object of the present invention is to provide a transfer device for use in a press machine which enables transfer members mounted on the leading end thereof to be automatically replaced with new ones.

To achieve the above-mentioned objects, according to the present invention, there is provided a transfer device for use in a press machine which comprises a longitudinally extending rail mounted in front of the press machine body by means of brackets fixedly secured, respectively, to side faces of the press machine body, said brackets being arranged to project outwardly from said side faces; a main body located in front of the press machine body so that it can be freely moved along said rail; a lift member mounted on said main body so that it can be freely moved in the vertical direction; transfer means fitted to said lift member so that it can be freely moved back and forth with respect to the press machine body; and drive means for driving said main body, said lift member and said transfer means, respectively.

Further, the above-mentioned transfer means comprises a plurality of transfer members arranged in spaced-apart relationship in the longitudinal direction of a bed of the press machine, and the arrangement is made such that the space between at least one of these transfer members and a group of the other transfer members can be adjusted.

Moreover, said transfer members are arranged so that they can be attached and detached freely through a holder by moving the latter back and forth with respect to the press machine body, and at the outside of one side end of the press machine body there are provided storage shelves adapted to house a plurality of transfer members each of which is different in shape at space intervals in the vertical direction.

BRIEF DESCRIPTION OF THE DRAWINGS

The above, many other advantages, features and additional objects of the present invention will become apparent to those skilled in the art upon making reference to the detailed description and accompanying drawings in which preferred structural embodiments incorporating the principle of the present invention are shown by way of illustrative example.

DETAILED DESCRIPTION OF THE PREFERRED EMBODIMENTS

Figure 1:
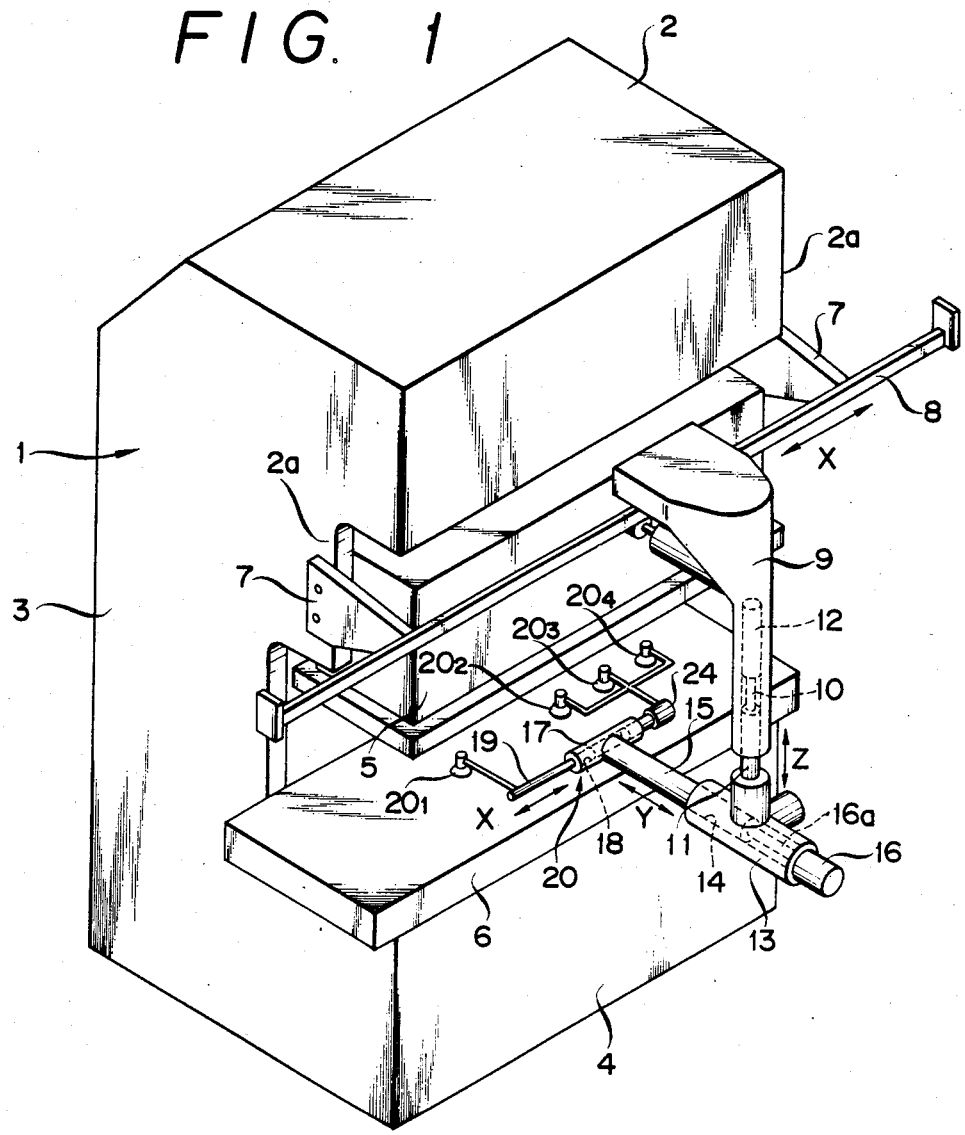
FIG. 1 is an overall perspective view showing a preferred embodiment of a press machine according to the present invention.

Referring to FIG. 1, a press machine body 1 comprises an upper body 2, an intermediate body 3 and a lower body 4 thus forming a C-shaped structure, the upper body 2 having a vertically, freely movable slide 5 fitted thereto, while the lower body 4 having a bed 6 mounted thereon.

A rail 8 is transversely supported by brackets 7, 7 fixedly secured to both side faces 2a, 2a of the above-mentioned upper body 2 and which project outwardly from both side faces 2a, 2a so that it may extend in front of the press body 1. A main body 9 is mounted so that it may be slidably moved along the rail 8 in the longitudinal direction of the bed 6 shown by arrow X.

The main body 9 has formed therein a longitudinally extending bore in which a rod member 11 is fitted so that it may be slidingly moved by a piston rod within a cylinder 12 in the vertical direction (or in the directions shown by arrow Z), said rod-shaped member 11 having a lift member 13 attached thereto.

The lift member 13 has formed therein a transversely extending bore 14 in which a rod member 15 is fitted so as to be slidingly moved in the direction at right angles to the direction X (or in the directions shown by arrow Y). The rod member 15 is connected to a piston rod 16a of a piston 16.

Fixedly secured to the rod member 15 is a holder 17 having formed therein a longitudinally extending bore 18 in which a moving rod 19 is fitted so as to be slidingly moved in the longitudinal direction of the bed 6 (or in the directions shown by arrow X). The moving rod 19 has a first transfer member $\mathbf{20_1}$ such as a vacuum cup etc. fitted thereto and is arranged to be slidingly moved by means of a cylinder (not shown) in the longitudinal direction of the bed 6. Further, fitted in the above-mentioned holder 17 is an attachment rod 21 which has fixedly secured thereto second, third and fourth transfer members $\mathbf{20_2}$, $\mathbf{20_3}$ and $\mathbf{20_4}$.

Figure 2:
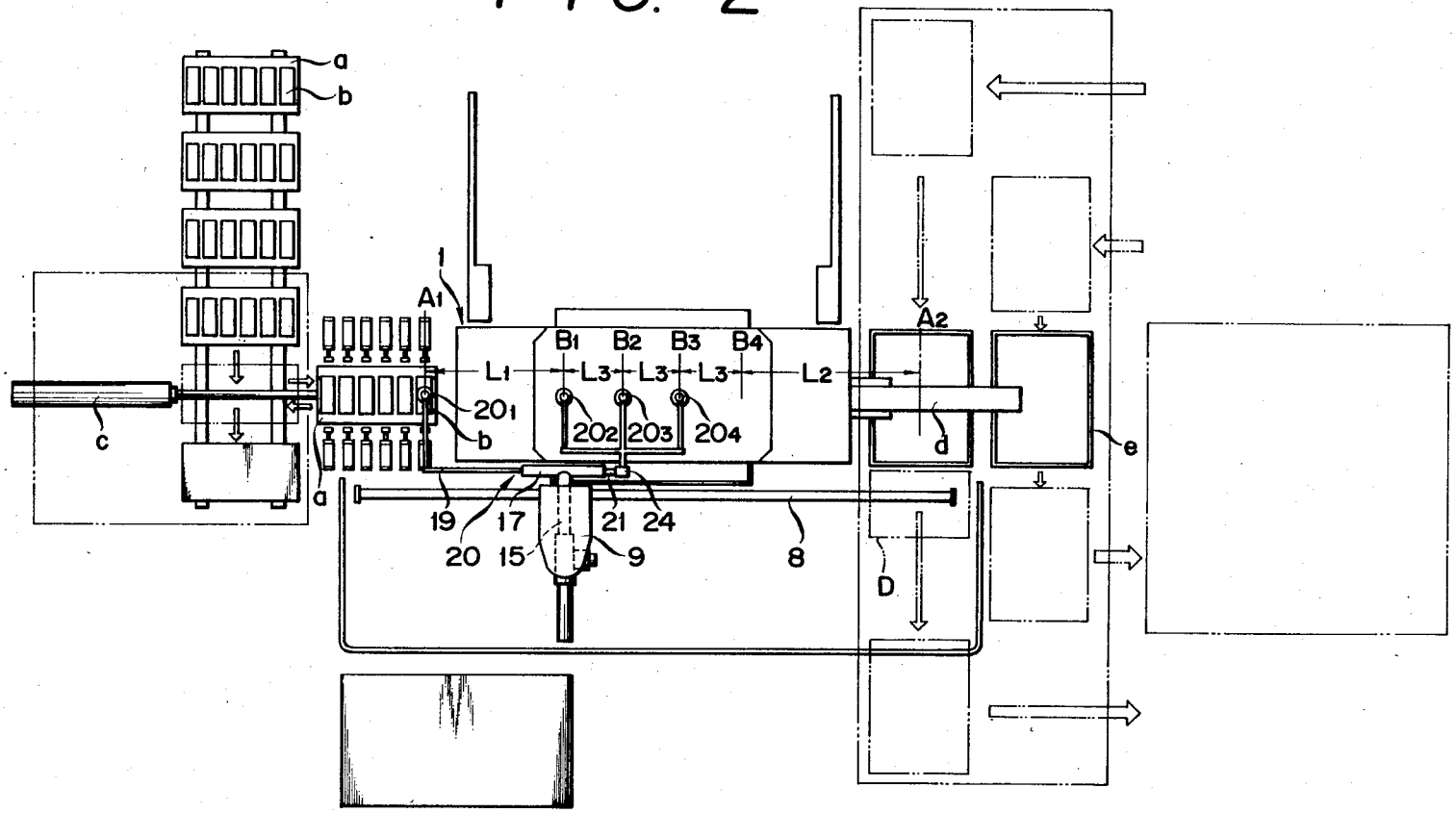
FIG. 2 is a schematic plan view of the embodiment shown in FIG. 1.

FIG. 2 is a schematic plan view of a press machine having first, second, third and fourth press machining positions or stations $B_1$, $B_2$, $B_3$ and $B_4$. In this drawing, reference character a denotes a palllet loaded with a plurality of blanks b and which is arranged to be transferred by the action of a cylinder c to a side loading station of the press machine body 1 in the direction shown by white arrows, whilst reference character d indicates a pressed article delivery conveyor located at a side unloading station of the press machine body 1, and e a pallet adapted to be loaded with pressed articles, the pallet e being arranged to be moved in the direction shown by white arrows of two point-dotted line.

Thus, when the main body 9 is moved to the right in the longitudinal direction of the bed 6 (or in the shown by X), the transfer device 20 will be moved from the loading station to the unloading station and when the lift member 13 is moved vertically to move the transfer device 20 up and down, blanks b at the station, and after pressing, pressed articles can be transferred to the unloading station.

In this case, in order to supply blanks b only to the second press machining position $B_2$ and press it there, it is only necessary to transfer the blanks in the manner mentioned below.

Figure 3:
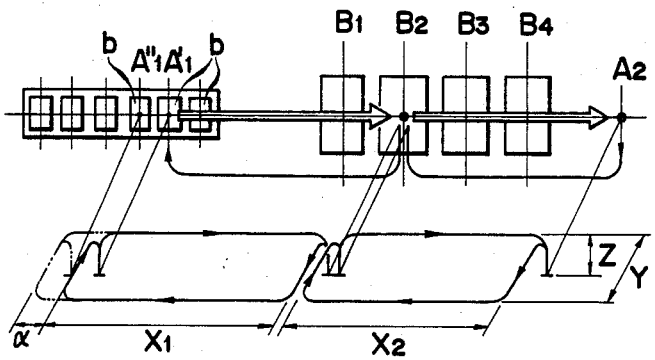
FIGS. 3 and 4 are explanatory views of the blank transfer operation in the press machine of the present invention.

Stated in brief, it is only necessary, as shown in FIG. 3, to transfer blanks b in turn from a first blank supply position $A'_1$ to the second press machining position $B_2$ over a stroke $X_1$, and where the condition is reached where there is no blank at the position $A'_1$, transfer blank b at a second blank supply position $A''_1$ to the position $B_2$ over a stroke which is longer than the stroke $X_1$ by $\alpha$, and send out pressed articles to a pressed article delivery position $A_2$ over a stroke $X_2$.

By so doing, blanks b can be located at a plurality of places.

Reference character Z denotes a vertical stroke, and Y a transverse stroke (i.e., stroke in a direction at right angles to the blank transferring direction).

Figure 4:
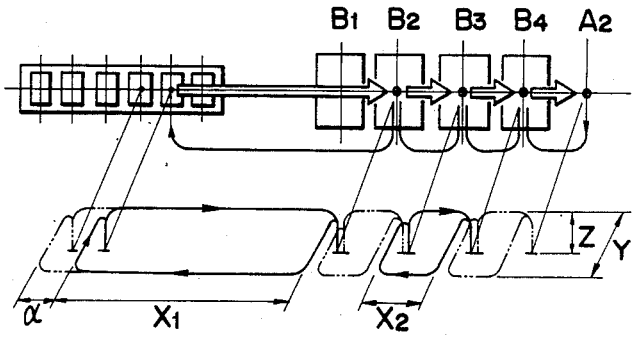

Further, in case of subjecting blanks b to press machining by the dies located at the second, third and fourth press machining positions $B_2$, $B_3$ and $B_4$, it is only necessary to operate the system as shown in FIG. 4.

Moreover, because the first transfer member $\mathbf{20_1}$ can be moved in the blank transferring direction or towards the other transfer members $\mathbf{20_2}$, $\mathbf{20_3}$ and $\mathbf{20_4}$ by sliding the moving rod 19 in the longitudinal direction thereof, the length of feed on the loading side can be differed from that on the unloading side.

Figure 5:
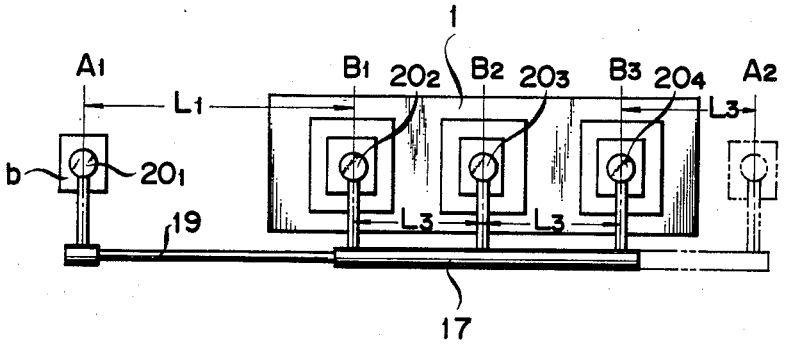
FIGS. 5 and 6 are explanatory views of the operation of the transfer device in the press machine of the present invention.

Therefore, even in the case where the distance $L_1$ between the position $A_1$ of blank b on the loading side (or destacking position) and the first press machining position $B_1$ is longer than the distance $L_3$ between each of the press machining positions $B_1$, $B_2$ and $B_3$, as shown in FIG. 5, blanks b can be transferred in turn without providing any idle station.

Figure 6:
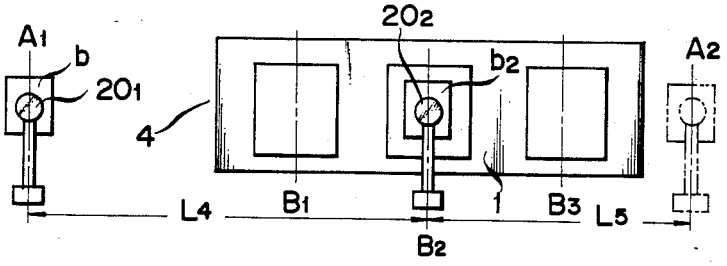

Further, in case of subjecting blanks b to press machining in turn only at the second press machining position $B_2$ as shown in FIG. 6, if the first transfer member $\mathbf{20_1}$ is moved by a distance $L_4$ when moving the main body 9 longitudinally, then blanks b can be transferred only to the second press machining position $B_2$. Further, the article $b_2$ which has been pressed at the second press machining position $B_2$ can be transferred to an unloading position $A_2$ by moving the transfer member $\mathbf{20_2}$ by a distance $L_5$.

When it is desired to carry out maintenance and inspection of the dies of the above-mentioned press machine, if the main body 9 is moved to a waiting position outside the press machine body 1 as shown by an imaginary or dotted line, the maintenance and inspection of the dies can be made easily for a short time.

Further, a pinion and a rack or equivalent device may be employed as the means for moving the main body 9, the lift member 13 and the rod members 15, 19.

Figure 7:
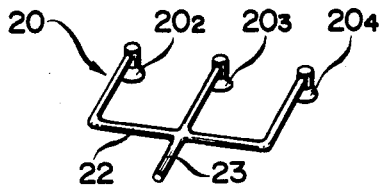
FIG. 7 is a perspective view of one embodiment of the transfer member employed in the press machine of the present invention.
Figure 8:
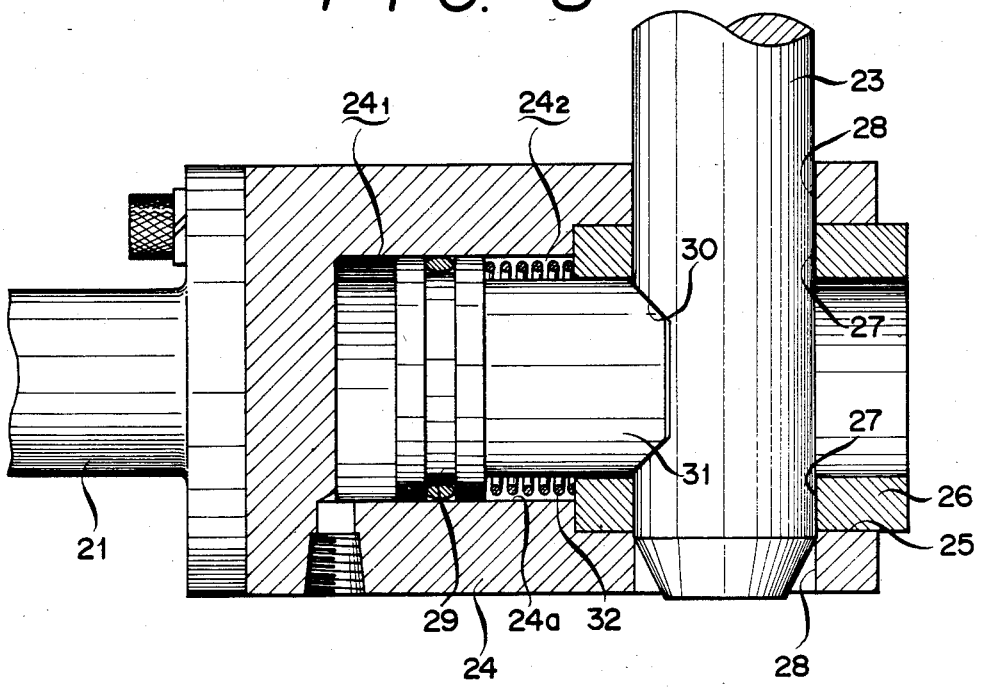
FIG. 8 is a fragmentary enlarged sectional view of a transfer member's attachment part.

As shown in FIG. 7, the above-mentioned second, third and four transfer members $\mathbf{20_2}$, $\mathbf{20_3}$ and $\mathbf{20_4}$ are attached, respectively, to a three-forked arm member 22 having an attachment rod 23 formed as an integral unit thereof. The attachment rod 23 is detachably fitted in the aforementioned arm 21.

Stating in brief, fastened by bolts to the arm 21 is a cylinder tube 24 whose inner peripheral wall 24 has formed therein a bore 25 with a large diameter. A cylindrical member 26 is fitted in the bore 25, and the member 26 and the cylinder tube 24 have formed therein through-holes 27 and 28, respectively, through which the above-mentioned attachment rod 23 passes. A piston 29 is mounted within the cylinder tube 24 so as to slide freely in the longitudinal direction of the bed 6, thus forming a first chamber $\mathbf{24_1}$ and a second chamber $\mathbf{24_2}$ on both sides thereof. The piston 29 comprises a locking piece 31 adapted to be fitted in or engageable with a recess 30 formed in the attachment rod 23 as a stopper. The locking piece 31 of the piston 29 is slidingly biased by the force of a spring 32 in such a direction as to disengage from the notch or recess 30, and the arrangement is made such that when fluid under pressure is supplied into the first chamber $\mathbf{24_1}$ the locking piece 31 is allowed to slidingly move so as to fit in the recess 30.

Figure 9:
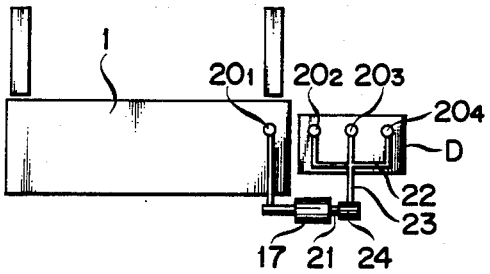
FIG. 9 is a schematic plan view for explaining the replacement operation of the transfer members.
Figure 10:
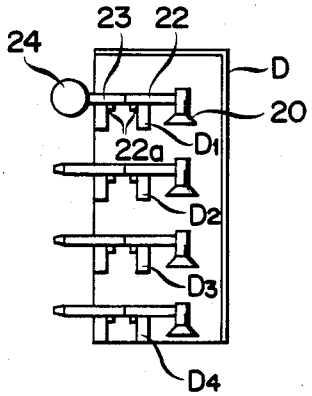
FIG. 10 is a schematic side elevational view of a storage shelf for the transfer members.

Thus, in case of effecting the replacement of the second, third and fourth transfer members $\mathbf{20_2}$, $\mathbf{20_3}$ and $\mathbf{20_4}$, the main body 9 is moved to one side end of the press machine body 1 so as to locate the holder 17 opposite to the storage shelf D, as shown in FIG. 9, and then the holder 17 is moved towards the back of the press machine body so as to advance the second to the fourth transfer members $20_2$ to $20_4$ within a predetermined shelf $D_1$, and subsequently the lift member 13 is lowered to locate and house the members $20_2$ to $20_4$ on and within the shelf $D_1$. As can be seen from FIG. 10, at that time, a projection 22*a* of the arm member 22 will abut against the shelf $D_1$ so that the arm member may be positioned so as not to move further.

Further, when the pressurized fluid within the first chamber $24_1$ is discharged and the piston 29 is slidingly moved by the force of the spring 32 to allow the locking piece 31 to be disengaged from the notch or recess 30 and also the holder 17 is moved forwards, the cylinder tube 24 is withdrawn from the attachment rod 23, and the transfer members $20_2$ to $20_4$ are detached from the arm 21.

If, after that, the lift member 13 is vertically moved so as to locate it opposite to the shelf $D_2$ in which the predetermined transfer members $20_2$ to $20_4$ are accommodated, and then the holder 17 is moved towards the back of the press machine body, then the attachment rod 23 is fitted in the holes 27 and 28. And then, pressurized fluid is supplied into the first chamber $24_1$ to slidingly move the piston 29 therein to thereby engage the locking piece 31 with the notch or recess 30 so that new transfer members $20_2$ to $20_4$ can be attached to the arm 21.

Thereafter, the lift member 13 is raised and the holder 17 is moved towards the front of the press machine body to take out the transfer members $20_2$ to 24 from the shelf $D_2$, and then next transfer operation is made.

Thus, the transfer members 20 can be automatically replaced with new or different ones by making use of the operation of the transfer device itself.

It is to be understood that the foregoing description is merely illustrative of a preferred embodiment of the invention and that the scope of the invention is not to be limited thereto, but is to be determined by the scope of the appended claims.

What is claimed is:

1. A transfer device for use in a press machine to infeed workpieces for work, to advance workpieces from one workstation to another, and to outfeed finished workpieces comprising:

a longitudinal extending rail mounted in front of a body of said press machine by means of brackets fixedly secured, respectively, to side faces of said press machine body, said brackets being arranged to project outwardly along said side faces;

a main body located in front of said press machine body and movable along said rail;

a lift member mounted on said main body so as to be movable in a vertical direction;

a transfer means fitted to said lift member so as to be movable backwardly and forwardly with respect to the longitudinal direction of said press machine body to infeed workpieces for work, to advance workpieces from one workstation to another, and to outfeed finished workpieces, said transfer means including holder means and a plurality of transfer members arranged in spaced-apart relation in a longitudinal direction of a bed of said press machine and mountable in said holder means, said plurality of transfer members consisting of two groups of said transfer members, a first group of which is adjustable along said longitudinal direction of said bed with respect to a second group such that the space interval between one of said groups with respect to the other is adjustable as said main body is moved along said rail, whereby said transfer means can provide a different length of infeed transfer and a different length of outfeed transfer during a single longitudinal stroke, while maintaining the ability to transfer workpieces from one workstation to another, all in a direction along the longitudinal direction of said press bed, at least one of said transfer members being detachably stowable on said press machine body so as to be freely attachable and detachable to said transfer means by moving said holder means backwardly and forwardly with respect to said press machine body; and drive means for driving said main body, said lift member and said transfer means respectively.

2. The transfer device according to claim 1, further comprising a plurality of storage shelves provided externally of one of said side faces of said press machine body, said storage shelves being adapted to each house one of said plurality of transfer members, said housed transfer members each being different in shape and arranged on said shelves at predetermined vertical intervals whereby said holder means may be aligned with said storage shelves and moved backwardly and forwardly with respect to said press machine body for attachment and detachment of said transfer members to said holder means.

* * * * *